United States Patent [19]

Zeloof

[11] 4,325,420

[45] Apr. 20, 1982

[54] APPARATUS FOR PREPARING WOOD FOR BENDING

[76] Inventor: Haskel Zeloof, 42 Bentley Ave., Trenton, N.J. 08619

[21] Appl. No.: 99,859

[22] Filed: Dec. 3, 1979

[51] Int. Cl.[3] ..... B27H 1/00

[52] U.S. Cl. ..... 144/271; 34/73

[58] Field of Search ..... 34/73; 144/271, 327

[56] References Cited

U.S. PATENT DOCUMENTS 419,798 1/1890 Sampson ..... 144/271

992,114 5/1911 Curry ..... 144/271

*Primary Examiner*—W. D. Bray

*Attorney, Agent, or Firm*—Daniel E. Kramer

[57] ABSTRACT

A portable extendable inclined boiler having an open and a closed end, for steaming and thereby softening wooden members for later bending including: a low water cutoff utilizing a thermostat mounted on the boiler wall near the heater; a low water cutoff actuated by the reduction in weight of boiler heater to a predetermined minimum; a steam control thermostat mounted at the open end of the boiler which temporarily turns off the heater when excess steam is being produced; and an integral boiler water measure utilizing a weep hole in the wall of the boiler for providing an indication of the correct boiler water charge to the operator.

9 Claims, 4 Drawing Figures

APPARATUS FOR PREPARING WOOD FOR BENDING

FIELD OF THE INVENTION

The invention relates to portable equipment used in the process of heating and steaming wood for the purpose of temporarily softening it to allow it to be bent.

PRIOR ART

Portable tubular boilers have long been known, as exemplified by U.S. Pat. No. 3,030,711 by N. H. Warring, Apr. 24, 1962, and by articles in Handicraft Magazine such as "Put a Bend in Wood" by Manly Banister; *Popular Mechanics,* October 1962, page 192ff., and especially FIG. 12.

BRIEF SUMMARY OF THE INVENTION

The invention is directed toward portable apparatus for steaming wood for the purpose of softening it in preparation for bending.

The apparatus is a tubular boiler having an open and a closed end and having a heater at its closed end and constructed with an extendable section so the boiler can be collapsed and thereby stored conveniently yet can be extended to treat pieces of wood that are long compared to its collapsed length.

The boiler is designed for achieving convenience in use and for conserving energy:

A bleed hole is provided in the wall of the boiler at the desired water level to signal by emitting water that sufficient has been added.

A thermostat at the open end of the boiler is provided to temporarily shut off the heater when the temperature at the end approaches the boiling point of water. When this condition arises it indicates that steam in excess of that required for the heating and softening function is being generated and is wastefully escaping into the atmosphere.

A thermostat is provided, positioned on the wall of the boiler adjacent the heater but closer to the open end of the boiler. The thermostat is set to open its contacts at a temperature higher than the boiling point of water. When the water level in the boiler drops by evaporation to a level below the high end of the heater, the heater can heat the boiler wall, and therefore the adjacent thermostat, to a temperature higher than the boiling point of water, causing the thermostat to open the circuit to the boiler heater.

A movable leg is provided toward the open end of the boiler for supporting it in an inclined position. The leg is positioned so with the minimum safe charge of water in the boiler, the weight of the wood under treatment and the weight of the open end of the boiler is sufficient to cause the boiler to become unbalanced, causing the closed end to rise sufficient to activate and open a switch connected in series with the boiler heater. When an adequate change of water is placed in the boiler, the closed end is held to the floor by the additional weight of the water, and the switch contacts close, allowing the heater to be energized.

Supports are placed within the boiler in such a way that the wood to be softened is held in a cantilever fashion. As the wood softens, it bends. A switch is so positioned that the bending wood touches and actuates the switch when it has softened adequately. The switch stops the action of the boiler heater and actuates an alarm to inform the operator that the steaming operation is complete.

DETAILED DESCRIPTION OF THE INVENTION

Figure 1:
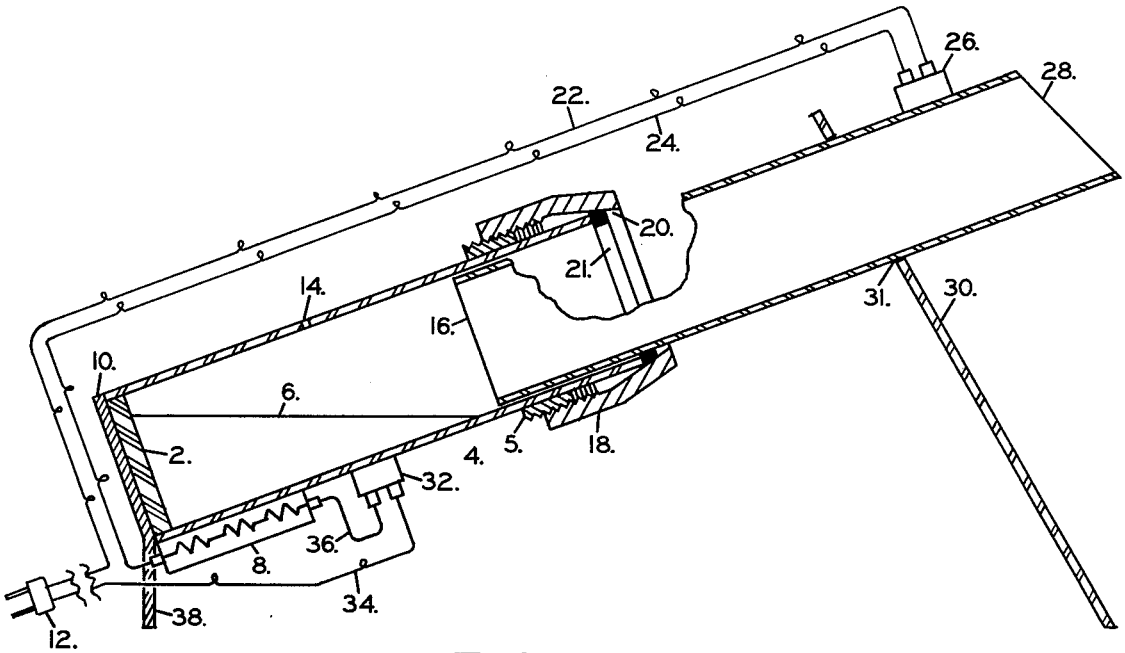
FIG. 1 shows a cross-section of a boiler for wood bending embodying an extendable section, a thermostat at at the boiler outlet, a low water thermostat adjacent the heater, and a full boiler charge indicating hole.

FIG. 1 shows in cross section a wood-bending boiler incorporating several of the improvements of the invention. The main tube 4 has a leg 38 mounted at its closed end 2; near the open end, an externally threaded ring 5 is securely attached to tube 4 as by brazing; and a collet 18, which is internally threaded at one end and internally tapered at the other end. As the collet 18 is turned, with its threads engaging the mating threads of ring 5, it slowly moves toward the closed end 2. Inner tube 16, whose outside dimension is selected to be slightly smaller than the inside dimension of outer tube 4 so as to facilitate its sliding movement in or out of the outer tube 4, is located within the outer tube 4 and projecting in part from it. As collet 18 is turned in a direction to move it slowly toward closed end 2, a gasket 21 is compressed against inner tube 16 by the inner conical surface 20 of collet 18. The compressed gasket 21 performs the dual function of sealing the gap between tube 16 and tube 4 and holding tube 16 in fixed position with respect to tube 4. Front leg 30, whose shape is more clearly shown in FIG. 2, has a hole 31 which has a diameter somewhat larger than the diameter of inner tube 16. For example, tube 4 will have an outer diameter of 3.125" (0.0794 m) with an inside diameter of 3" (0.0762 m). The inner tube 16 will have an outside diameter of 2.95" (0.0749 m) with an inside diameter of 2.83" (0.0719 m). The hole 31 in front leg 30 is 3.1" (0.0787 m) which will allow the leg 30 to lock, forming an angle of about 75°, with the portion of tube 16 that protrudes through it. This leg 30, having a hole which is substantially larger (typically 5%) than the outside diameter of the inner tube 16, can be readily slid off the tube 16 for storing when the tube 16 has been slid out of gasket 21 and outer tube 4. Since the position of leg 30 on the portion of tube 16 which protrudes beyond collet 18 is completely adjustable, the position of leg 30 may be adjusted to provide the best combination of balance and stability with the wood members intended to be bent (see FIG. 3) laying within the boiler tube 4 and its extension tube 16.

Boiler tube 4 has a small hole 14 positioned at a predetermined distance from closed end 2. When the tube 4 is held vertically and water is poured into it until water flows and then just ceases flowing from hole 14, there will be adequate water inside to cover the heater and to provide a reserve so that the boiler can continue to operate during a period which is long enough to soften the woods to which it will normally be applied when the boiler 4 is tilted into its operating position. There is no need to close hole 14 since the small pressure difference between the interior of tube 4 and the exterior allows a miniscule quantity of steam to escape during normal operation.

Heating element 8, is formed in the shape of a cartridge. Ift has an electric resistance element, typically Nichrome, embedded inside the metal tube with electrical connections at each end. It is mechanically and thermally secured to the periphery of tube 4, adjacent the closed end, and at the radial position on tube 4, which will be lowermost when leg 38 is resting on a horizontal surface. The power to heater 8 is supplied by the plug 12 adapted to fit an ordinary 115 V, single phase, 60 cycle, domestic outlet, although the heater could well be selected for 230 V, 50 cycle, or any other current characteristic, including 6 or 12 volt, D.C., for which the designer would care to select the heating element and the control thermostat. One wire 34 from plug 12 connects to low water thermostat 32, which is mounted adjacent heater 8, but closer to the open end of tube 4. This thermostat 32, which is connected to heater 8 by wire 36, is intended to be closed during normal operation when its temperature is at or below approximately 220° F. (104° C.). So long as the water level 6 covers the internal surface of tube 4, which is directly adjacent to both heating element 8 and thermostat 32, the thermostat 32 will be at a temperature at sea level no higher than 212° F. (100° C.) and it will be closed. Should the water level 6 fall to position C on the interior of tube 4, then the heater 8 will be able to directly warm thermostat 32 without the cooling effect of a layer of water 6. The thermostat 32 will immediately rise to a temperature higher than its setting. Its contacts will open and shut off the power to heater 8 and thereby prevent distructive overheating of the heater, the tube 4 and its contents.

The other terminal of heater 8 is connected by wire 24 to thermostat 26, which is located at the outlet end 28 of inner tube 16. Thermostat 26 is similar to thermostat 32 in that both open on temperature rise; however, thermostat 26 is set so that its contacts open at approximately 200° F. (93 C.) and close approximately 5° F. (3 C.) lower or 195° F. (90 C.) whether or not there is material to be bent within tubes 4 and 16. With the heater 8 functioning to cause water 6 to boil, so long as the level of water is above point C, the heater will operate to boil water and cause steam to be emitted from its surface and to flow toward outlet 28. Since heater 8 is selected for reasonably quick action to raise the temperature of the quantity of water 6 within the bottom of the tube 4 from room temperature to the boiling point, it has more than enough wattage to cause the water to boil away in a relatively short period. However, when thermostat 26 reaches a temperature of 200° F., indicating that steam has started to flow through outlet 28, it opens the circuit, preventing further flow of electricity to heater 8, and allows its temperature to drop. Therefore, just enough heat is added on a cyclic basis to the water 6 in the boiler to maintain the outlet 28 of tube 16 at a temperature just below the boiling point of water so that significant quantities of water vapor are not discharged into the air and wasted. The temperature throughout the interior of the tubes 4 and 16 is retained at or near the boiling point, so that the wood articles therein can be most expeditiously heated to the satisfactory bending temperature and condition of moisture with minimum loss of water from the outlet 28 and with minimum usage of electricity for this purpose.

For instance, a satisfactory heater wattage for heater 8 is 500. This provides a heat input of 1700 Btu/hr. If hole 14 is located 4" from closed end 2, the water charge will be 1 lb. (454 gm). The heater will start the water boiling in about 7 minutes. Once the water boils, resulting steam will condense on the wood and the walls of the boiler. If the overall extended boiler length is 5 feet, the heat loss from the boiler wall to the ambient will be about 900 Btu/hr. (263 watts). The heater therefore has 800 Btu/hr. (234 watts) excess capacity. It is important for the heater to have excess capacity to provide proper operation under reduced voltage conditions and to provide reasonably fast heat-up. However, once the start-up is complete and the wood and boiler are up to temperature, the 800 Btu/hr. excess capacity will cause approximately 0.7 lbs./hr. (0.088 gm/sec) of water to boil away and be lost to the atmosphere. This is an unacceptably large proportion of the initial water charge which would require the operator to replenish the water supply every 15 or 20 minutes. With the apparatus of the invention, thermostat 26 will turn off the flow of electrical power to heater 8 whenever its temperature rises above 200° F. (93.3 C.) thereby adjusting the average heat input to the boiler to the sum of the net heat required to heat the wood and the heat lost through the boiler walls, and simultaneously providing heat input to the water at the closed end of the boiler such that the interior of the boiler is maintained full of steam for actively and effectively softening the wood product placed therein.

Figure 2:
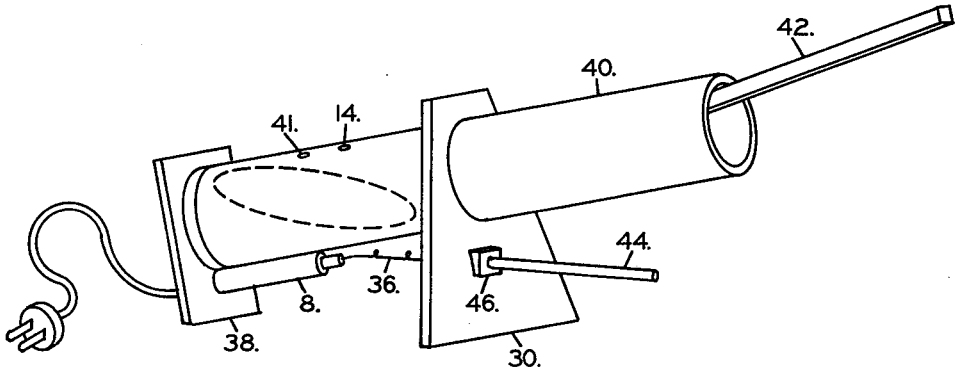
FIG. 2 shows a portable boiler with a movable intermediate leg which is intended to be positioned along the length of the boiler at such a point that when the amount of the water in the boiler decreases to a predetermined amount, the entire boiler assembly will tilt, actuating a cutoff switch.

FIG. 2 shows a portable wood bending boiler having tube 40, a closed end having a foot 38 attached thereto, a heater 8 supplied with power from a line cord with a low water cutoff switch 46 mounted on a leg 30. The switch 40 has an actuating lever 44 connected to it and extending forward of the leg toward the open mouth of boiler tube 40. Leg 30 is movable with respect to the length of the boiler tube 40.

The front leg 30 is slidable over the exterior of the tube 40 and can be positioned at and locked in any spot over that length. In use, the leg 30 is positioned at some arbitrary point over the length of boiler tube 40. Water is poured into the opening of boiler tube 40 until it weeps from hole 41. At that point, the filling operation is stopped and leg 30 is positioned by trial and error along the length of boiler tube 40 until the closed portion containing water and the open portion containing the product to be bent, 42, just balance. Then a planned increment of water, say 4 ounce (110 gms) is poured into the open end of the boiler. Electrical energy is then supplied to heater 8 which causes the water to boil and the wood softening operation to take place. Should more than 4 ounces of water be evaporated from the body of water maintained at the closed end of tube 40, the balance point will be reached and passed, the boiler will pivot on leg 30 and leg 30 will rotate forward until the lever 44 of switch 46 contacts the ground, preventing any further rotation of the boiler tube 40 but at the same time actuating switch 46 to terminate the operation of heater 8, thereby preventing any overheating of the tube 40 or the heater 8 and causing the equipment to be put into a fail-safe position from which its restored operation can be achieved simply by the addition of water to the tube 40 and the restoration of the physical condition of the tube 40 with its rear leg 38 in the lowermost position.

Figure 3:
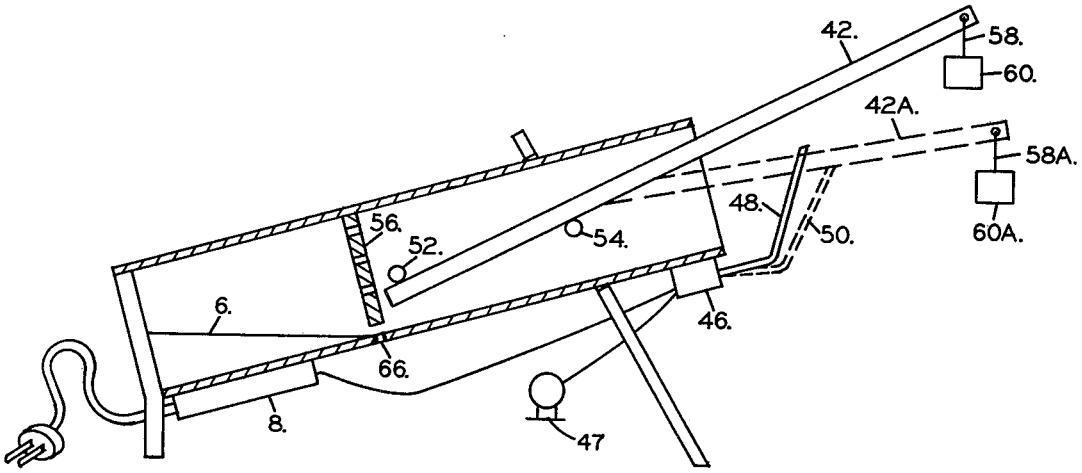
FIG. 3 is a cross-section of a boiler having internal members to allow supporting the wood to be bent in a cantilever condition, so that as the wood softens, it bends, and, in bending, actuates a cutoff switch.

FIG. 3 is a side elevation and cross-section of a modification of the invention which employs internal pins 52 and 54 to position the piece 42 to be bent in a cantilever fashion. Switch 46 mounted to the boiler has actuating arm 48 projecting into the open outlet area of the boiler. Switch 46 is operatively connected to allow or prevent heater 8 from functioning. When lever 48 is in its uppermost or relaxed position, the switch 46 is closed, allowing power to be fed to heater 8 and the water in the base of the boiler to boil. After a period of operation, the wood piece 42 softens, and, under its weight, or under the weight of an additional mass 60, attached to its end, the wood piece bends from its initial position 42 to a new position 42*a*. In this new, softened position, the wood piece presses upon switch lever 48, causing switch 46 to acuate to cut off the flow of heating electricity to heater 8. At the same time, if desired, another contact and switch 46 could be arranged to actuate an alarm 47 so that the operator would be alerted to remove the work piece and place it in its bending jig to assume its final, bent condition.

Figure 4:
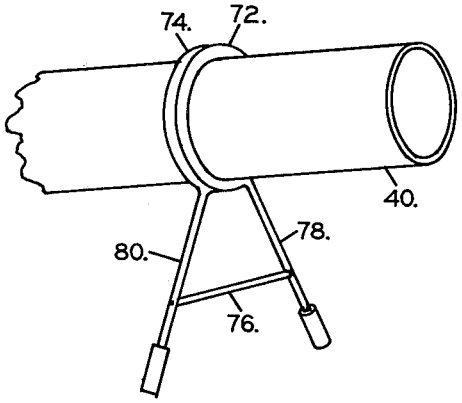
FIG. 4 shows a detail of a leg structure for the wood bending boiler which can be easily folded, removed, and compactly stored during periods of non-use.

FIG. 4 shows a leg construction which can be applied to the structure of FIG. 1 instead of the leg 30 shown in FIG. 1. This leg construction is easy to manufacture and has the advantage of collapsibility for the purpose of convenient and compact storage. The legs 80 and 78 terminate at their upper ends in rings 74 and 72 respectively. Each ring is somewhat larger in inside diameter than boiler tube 40. The lower portions of the legs are connected by the flexible cord 76, whose length is adjusted to maintain the maximum angular spread between leg 78 and 80 to an acute angle typically in the range of 30°–60°. The rings 72 and 74 can be slid together with the length of the tube and positioned at any convenient spot. The tips of the legs 78 and 80 are set on the ground, spread apart as far as the flexible cord 76 will allow, creating a firm triangular structure on which the boiler assembly can rest for use.

I claim:

1. Improved apparatus for boiling water and steaming wood in preparation for bending, comprising tube means for holding a mass of water, said means having an open and a closed end, a front leg supporting the open end at an elevation above the closed end, heater means positioned in heat transfer relation to said closed end for boiling said water; wherein the improvement comprises means for terminating the action of said heater means on a predetermined reduction of the mass of water.

2. Improved apparatus as in claim 1 where said terminating means constitutes a thermostat positioned in heat transfer relationship to said tube means and said heater means.

3. Improved apparatus as in claim 1 where the improvement further comprises tube means having a balance point and two unbalanced positions, a closed-end-higher position and a closed-end-lower position means for moving said front leg to said balance point and means for sensing both positions and terminating the action of the heater in response to the closed-end-higher position.

4. Improved portable apparatus for boiling water and steaming wood in preparation for bending, comprising tube means having an open end and a closed end, heater means positioned to heat the closed end, a tubular extension adapted to slideably fit within said tube means and means for temporarily locking said slideable extension into a position partly within and partly without said tube means.

5. Improved wood steaming apparatus as in claim 4 where the locking means includes a gasket positioned at the open end of the tube means and a threaded portion with a tapered interior which acts to compress said gasket and thereby to lock the slideable portion to the tube means.

6. Improved apparatus for boiling water and steaming wood in preparation for bending, comprising tube means having a closed end and an open end, said tube means constituting means for containing a mass of water positioned at said closed end, heater means positioned in heat transfer relationship to said closed end for heating and boiling said water, wherein the improvement comprises thermostat means for sensing the temperature at said open end and acting to suppress the heater action when said temperature approaches the boiling point of water.

7. Improved apparatus for steaming and softening wood in preparation for bending, comprising enclosure means for containing wood and confining steam, steam supply means having control means for supplying and controlling steam flow to the enclosure means, wherein the improvement comprises: means for applying force on the wood, said force being sufficient to cause a lesser bending movement of the wood when the wood is hard and a greater bending movement of the wood when the wood has softened, and means for sensing the movement of the wood and actuating said control means.

8. Improved apparatus as in claim 7 where the means for sensing the movement of the wood acts on the control means to reduce the steam supply when a greater movement is sensed.

9. Improved apparatus as in claim 7 including alarm means where the means for sensing the movement of the wood actuates the alarm means when a greater movement is sensed.

* * * * *